US010854994B2

(12) United States Patent
Niroo Jazi et al.

(10) Patent No.: US 10,854,994 B2
(45) Date of Patent: Dec. 1, 2020

(54) BROADBAND PHASED ARRAY ANTENNA SYSTEM WITH HYBRID RADIATING ELEMENTS

(71) Applicant: PERASO TECHNOLOGIES INC., Toronto (CA)

(72) Inventors: Mahmoud Niroo Jazi, Toronto (CA); Mihai Tazlauanu, North York (CA)

(73) Assignee: PERASO TECHNOLGIES INC., Toronto (CA)

( * ) Notice: Subject to any disclaimer, the term of this patent is extended or adjusted under 35 U.S.C. 154(b) by 178 days.

(21) Appl. No.: 15/711,486

(22) Filed: Sep. 21, 2017

(65) Prior Publication Data

US 2019/0089069 A1 Mar. 21, 2019

(51) Int. Cl.
*H01Q 1/38* (2006.01)
*H01Q 21/22* (2006.01)
(Continued)

(52) U.S. Cl.
CPC ..... *H01Q 21/22* (2013.01); *H01Q 1/2275* (2013.01); *H01Q 1/2283* (2013.01);
(Continued)

(58) Field of Classification Search
CPC ..... H01Q 21/22; H01Q 1/38; H01Q 13/10; H01Q 21/065; H01Q 1/2291;
(Continued)

(56) References Cited

U.S. PATENT DOCUMENTS

2007/0164420 A1* 7/2007 Chen ..... H01L 25/16 257/691
2007/0229366 A1* 10/2007 Kim ..... H01Q 1/243 343/700 MS (Continued)

OTHER PUBLICATIONS

Zhang, Yue Ping, and Duixian Liu. "Antenna-on-chip and antenna-in-package solutions to highly integrated millimeter-wave devices for wireless communications." IEEE Transactions on Antennas and Propagation 57.10 (2009): 2830-2841.

(Continued)

*Primary Examiner* — Dieu Hien T Duong
(74) *Attorney, Agent, or Firm* — Perry + Currier

(57) ABSTRACT

A broadband phased array antenna system is set forth comprising a support member; an antenna array mounted to the support member, the antenna array having a plurality of uniformly excited hybrid radiating elements arranged in a symmetric array on a substrate; a baseband controller mounted to the support member; a radio controller mounted to the support member for modulating and demodulating signals between the baseband controller and antenna array; and a communications interface for removably connecting and disconnecting the antenna system. In one aspect, the antenna array comprises a substrate; a plurality of uniformly excited hybrid radiating elements arranged in a symmetric array on the substrate; a hybrid feeding network for transmitting RF-signals to the hybrid radiating elements; and artificial materials surrounding opposite sides of the symmetric array for suppressing edge scattered fields and increasing gain of the antenna system.

12 Claims, 2 Drawing Sheets

(51) Int. Cl.

| | |
|---|---|
| ***H01Q 21/00*** | (2006.01) |
| ***H01Q 1/22*** | (2006.01) |
| ***H01Q 9/04*** | (2006.01) |
| ***H01Q 13/10*** | (2006.01) |
| ***H01Q 21/06*** | (2006.01) |
| ***H01Q 21/28*** | (2006.01) |
| *H01Q 1/00* | (2006.01) |
| *H01Q 3/38* | (2006.01) |

(52) U.S. Cl.
CPC ..... *H01Q 1/2291* (2013.01); *H01Q 1/38* (2013.01); *H01Q 9/0421* (2013.01); *H01Q 13/10* (2013.01); *H01Q 21/0025* (2013.01); *H01Q 21/065* (2013.01); *H01Q 21/28* (2013.01); *H01Q 1/007* (2013.01); *H01Q 3/385* (2013.01)

(58) Field of Classification Search
CPC .... H01Q 1/2283; H01Q 21/28; H01Q 1/0025; H01Q 1/2275; H01Q 9/0421
See application file for complete search history.

(56) References Cited

U.S. PATENT DOCUMENTS

2009/0009399 A1* 1/2009 Gaucher ..... H01Q 21/0006 343/700 MS
2017/0062953 A1* 3/2017 Teshima ..... H01Q 21/28
2018/0083352 A1* 3/2018 Eshaghi ..... H01Q 1/42

OTHER PUBLICATIONS

Liu, Duixian, et al. "Packages with integrated 60-GHz aperture-coupled patch antennas." IEEE Transactions on Antennas and Propagation 59.10 (2011): 3607-3616.
Kim, Tae-Young, et al. "A linear phased array antenna composed of inductive loaded patch antennas." IEEE antennas and wireless propagation letters 10 (2011): 1051-1054.
Nikolic, Marija M., Antonije R. Djordjevic, and Arye Nehorai. "Microstrip antennas with suppressed radiation in horizontal directions and reduced coupling." IEEE transactions on antennas and propagation 53.11 (2005): 3469-3476.
Wen, Ya-Qing, Bing-Zhong Wang, and Xiao Ding. "A wide-angle scanning and low sidelobe level microstrip phased array based on genetic algorithm optimization." IEEE Transactions on Antennas and Propagation 64.2 (2015): 805-810.
Awida, Mohamed H., Aladin H. Kamel, and Aly E. Fathy. "Analysis and design of wide-scan angle wide-band phased arrays of substrate-integrated cavity-backed patches." IEEE transactions on antennas and propagation 61.6 (2013): 3034-3041.
Ding, Zhuo-Fu, et al. "Design of a broadband, wide-beam hollow cavity multilayer antenna for phased array applications." IEEE Antennas and Wireless Propagation Letters 15 (2015): 1040-1043.
Valavan, Shenario Ezhil, et al. "Dual-band wide-angle scanning planar phased array in X/Ku-bands." IEEE transactions on antennas and propagation 62.5 (2014): 2514-2521.
Valavan, S. E., et al. "Planar dual-band wide-scan phased array in X-band." IEEE Transactions on Antennas and Propagation 62.10 (2014): 5370-5375.
Sandhu, Ali Imran, et al. "Radiating elements for shared aperture Tx/Rx phased arrays at K/Ka band." IEEE Transactions on Antennas and Propagation 64.6 (2016): 2270-2282.
Xia, Run-Liang, et al. "Wide-angle scanning phased array using an efficient decoupling network." IEEE Transactions on Antennas and Propagation 63.11 (2015): 5161-5165.
Xia, Run-Liang, et al. "Experimental investigation of wide-angle impedance matching of phased array using overlapped feeding network." IEEE Antennas and Wireless Propagation Letters 13 (2014): 1284-1287.
Cheng, You-Feng, et al. "Planar wide-angle scanning phased array with pattern-reconfigurable windmill-shaped loop elements." IEEE Transactions on Antennas and Propagation 65.2 (2016): 932-936.
Steyskal, Hans. "On the merit of asymmetric phased array elements." IEEE transactions on antennas and propagation 61.7 (2013): 3519-3524.
Aberle, J. T., and D. M. Pozar. "Analysis of infinite arrays of probe-fed rectangular microstrip patches using a rigorous feed model." IEE Proceedings H (Microwaves, Antennas and Propagation). vol. 136 No. 2 IET Digital Library, 1989.
Aberle, James T., and David M. Pozar. "Analysis of infinite arrays of one-and two-probe-fed circular patches." IEEE transactions on antennas and propagation 38.4 (1990): 421-432.
Chen, Richard L., et al. "Scan impedance of RSW microstrip antennas in a finite array." IEEE transactions on antennas and propagation 53.3 (2005): 1098-1194.
Liu, C-C., Alexander Hessel, and Jerry Shmoys. "Performance of probe-fed microstrip-patch element phased arrays." IEEE transactions on antennas and propagation 36.11 (1988): 1501-1509.
Liu, Chun-Mei, et al. "Wide-angle scanning low profile phased array antenna based on a novel magnetic dipole." IEEE Transactions on Antennas and Propagation 65.3 (2017): 1151-1162.
Pozar, D., and D. Schaubert. "Analysis of an infinite array of rectangular microstrip patches with idealized probe feeds." IEEE Transactions on Antennas and Propagation 65.3 (2017): 1151-1162.
Pozar, D., and D. Schaubert. "Scan blindness in infinite phased arrays of printed dipoles." IEEE Transactions on Antennas and Propagation 32.6 (1984): 602-610.
Pozar, David M. "Scanning characteristics of infinite arrays of printed antenna subarrays." IEEE transactions on antennas and propagation 40.6 (1992): 666-674.
Thors, Björn, Hans Steyskal, and Henrik Holter. "Broad-band fragmented aperture phased array element design using genetic algorithms." IEEE Transactions on Antennas and Propagation 53.10 (2005): 3280-3287.
Wang, Ren, et al. "Planar phased array with wide-angle scanning performance based on image theory." IEEE Transactions on Antennas and Propagation 63.9 (2015): 3908-3917.
Waterhouse, Rodney B. "The use of shorting posts to improve the scanning range of probe-fed microstrip patch phased arrays." IEEE Transactions on Antennas and Propagation 44.3 (1996): 302-309.

* cited by examiner

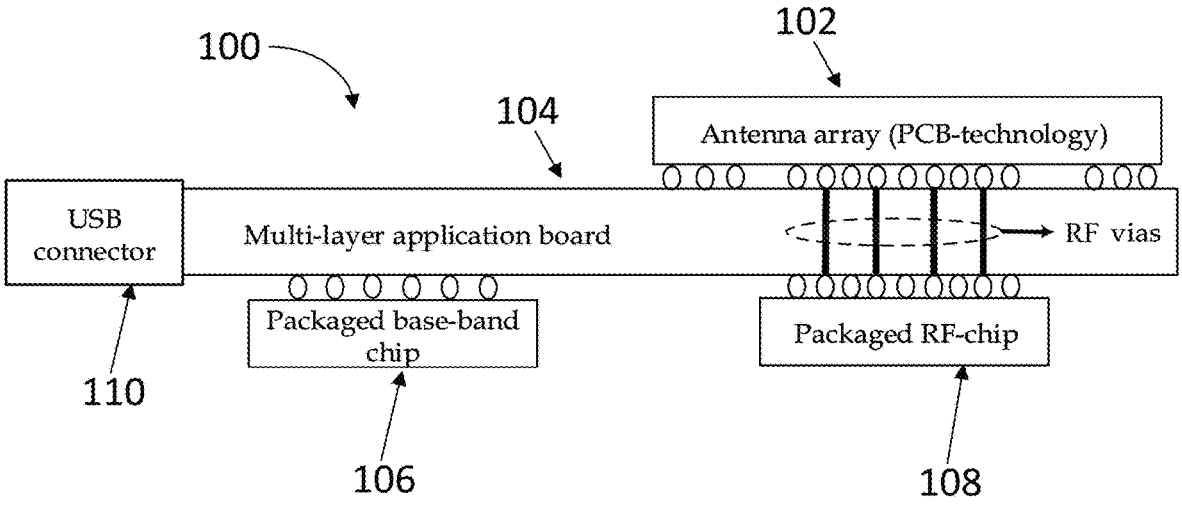
FIG. 1
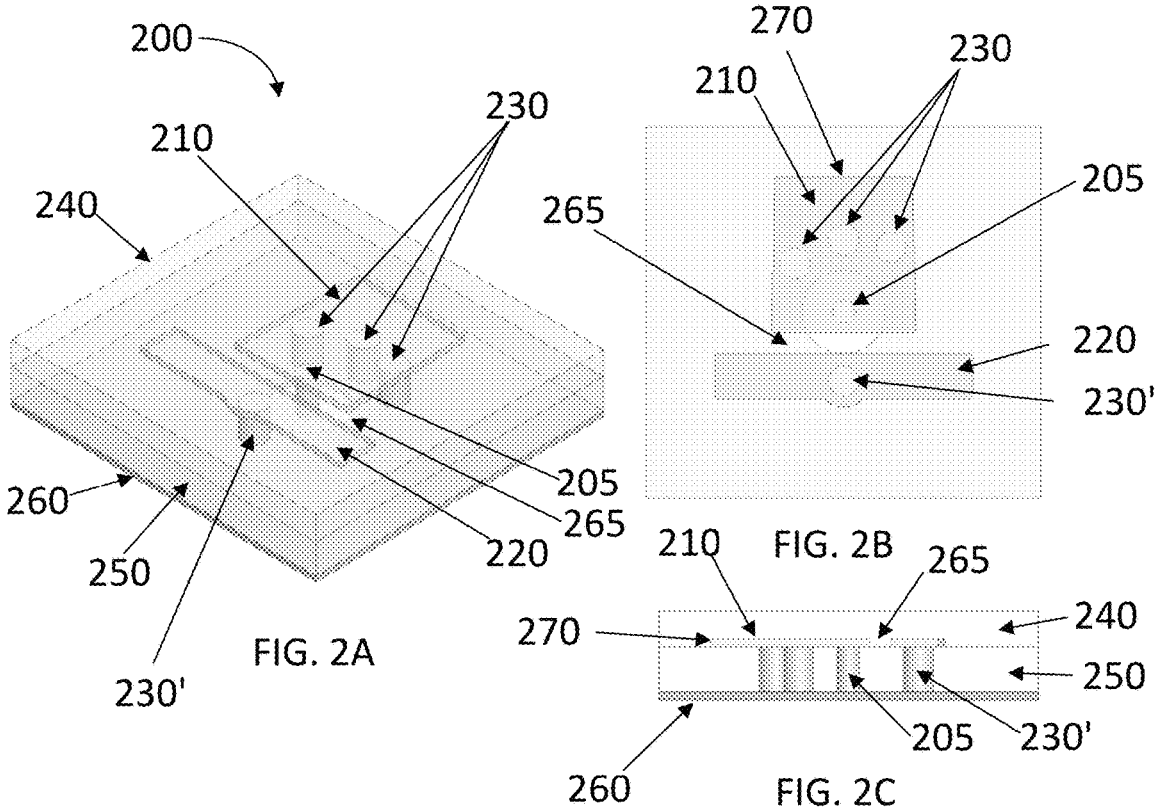
FIG. 2A
FIG. 2B
FIG. 2C

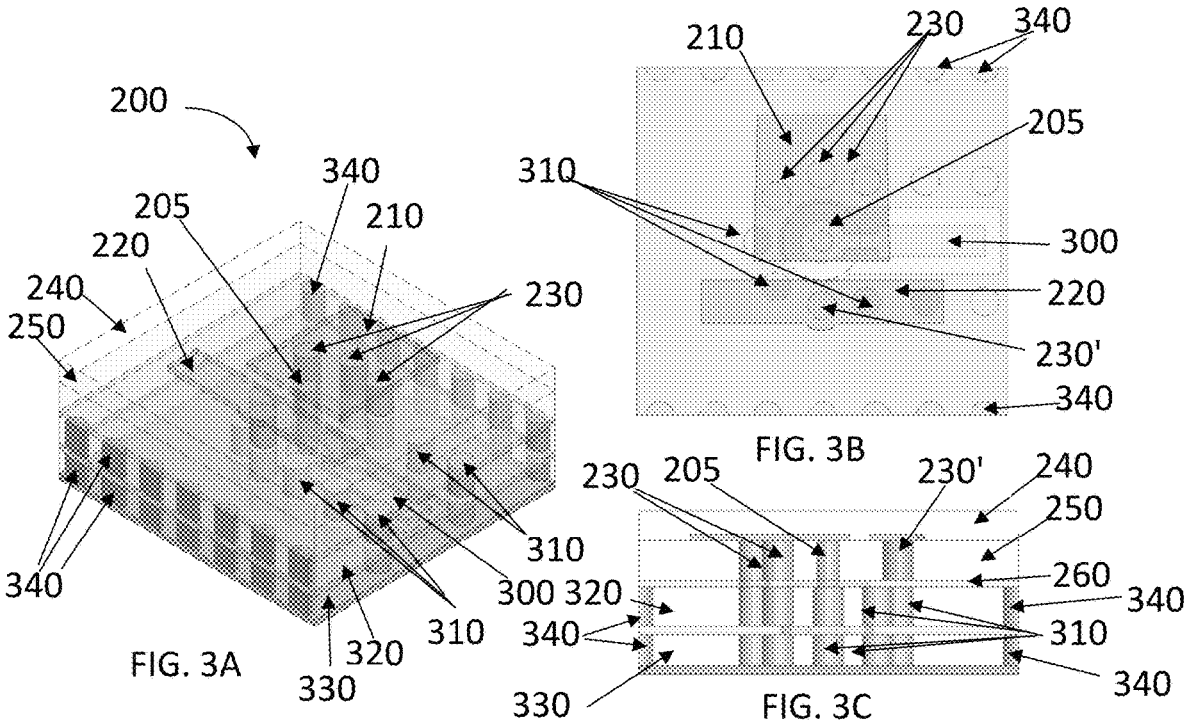
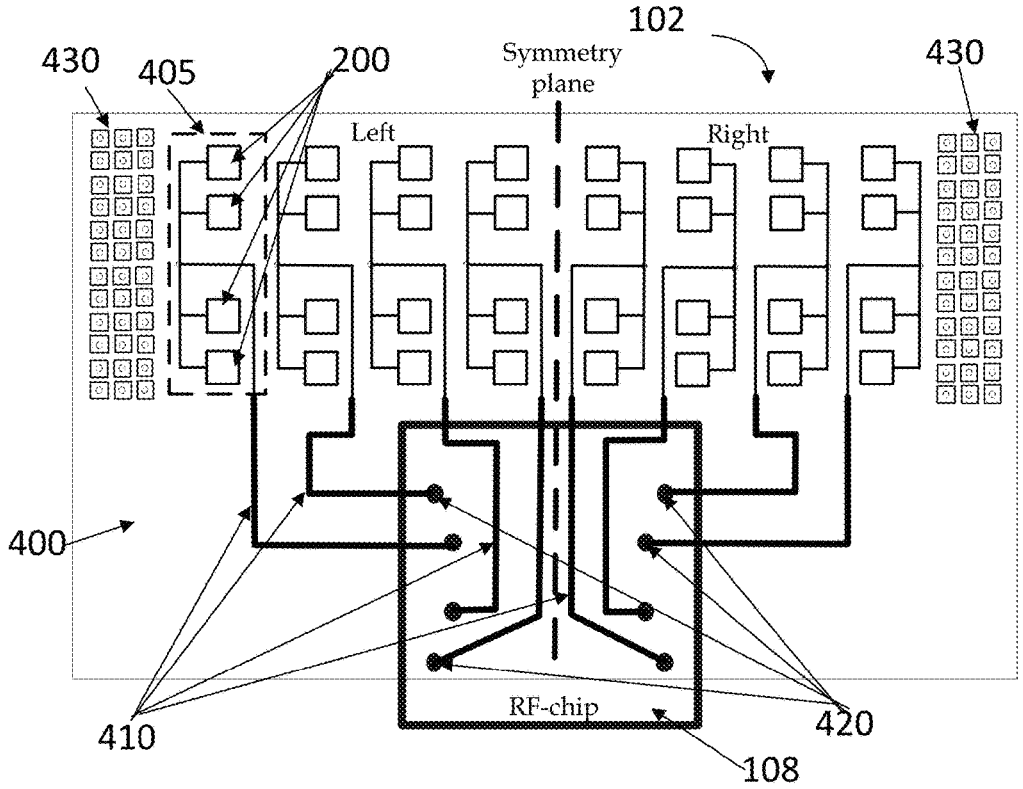
FIG. 4

BROADBAND PHASED ARRAY ANTENNA SYSTEM WITH HYBRID RADIATING ELEMENTS

FIELD

This specification relates to wireless communications, and more particularly to a broadband phased array antenna system with hybrid radiating elements.

BACKGROUND

Millimeter-wave (MMW) phased array planar antennas provide a convenient and low-cost solution to the problems of high propagation loss and link blockage associated with indoor and short range wireless communications over the 60 GHz frequency band (i.e. utilizing the Institute of Electrical and Electronics Engineers (IEEE) 802.11ad standard, also referred to as WiGig, which employs frequencies of about 56 GHz to about 66 GHz). Broadband phased array systems are known that utilize antenna-in-package (AiP) construction for integrating MMW phased array planar antennas and associated radio-frequency (RF) components, together with base-band circuitry, into a complete self-contained module (e.g. printed circuit board (PCB)).

Each such phased array system comprises an array of antennas for creating a beam of radio waves that can be electronically steered in different directions, without moving the antennas. The individual antennas are fed with respective RF signals having phase relationships chosen so that the radio waves from the separate antennas add together to increase the radiation in a desired direction. Although such antenna systems are effective and easier to optimally design at low frequencies, realizing maximum gain and scan coverage larger than ±45° over a bandwidth more than 15% for a given array size is a challenge in the MMW frequency range.

Microstrip patches, dipoles, and slots are the most commonly used elements in planar phased arrays with boresight radiation pattern. However, such elements are bandwidth limited to less than 10% for an annular coverage of at least ±45°. Moreover, the propagation of surface and traveling leaky waves on the dielectric surface of such elements worsens the radiation pattern gain drop when the beam is directed toward larger angles. For substrates with a dielectric constant in the range of 2-5, surface and traveling leaky waves increase with increasing thickness of the dielectric to achieve a larger element bandwidth. Because of the probe axial-current (normal to the patch and inside the second dielectric) and unbalanced feed geometry, the presence of surface and/or traveling waves worsens when a probe-fed patch antenna on a thick substrate is used as an element of the array. Furthermore, the input impedance of the patch is highly inductive making the wideband impedance matching difficult.

It is known in the prior art to increase the scan coverage to more than ±65° by using either artificial materials or elements with a magnetic dipole radiation mechanism. However, such solutions exhibit narrowband performance, and the total gain of the array with a given size is reduced because of the low gain element pattern. It has been theoretically proposed to break the radiating element symmetry by fragmenting its geometry to enhance the scan range. However, the resulting element bandwidth is limited to only a few percent.

From the foregoing, it will be appreciated that there is a need for optimally designed phased array elements and antenna systems that optimize bandwidth, gain, and scan coverage for short range and indoor wireless WiGig communication systems.

SUMMARY

According to an aspect of the invention, a broadband phased array antenna system is provided, comprising: a substrate; a plurality of uniformly excited hybrid radiating elements arranged in a symmetric array on the substrate; a hybrid feeding network for transmitting RF-signals to the hybrid radiating elements; and artificial materials surrounding opposite sides of the symmetric array for suppressing edge scattered fields and increasing gain of the antenna system.

According to another aspect of the invention, a hybrid radiating element is provided, comprising: a first dielectric layer stacked on a second dielectric layer; an RF-ground metallic layer disposed on the bottom of the second dielectric layer; a probe-fed patch antenna having a metallic radiating patch disposed on the top of the second dielectric layer and a conductive feed via between the metallic radiating patch and the RF-ground metallic layer; a metallic parasitic patch disposed on the top of the second dielectric layer and separated from the metallic radiating patch by a slot; and a plurality of shorting pins, one of said shorting pins creating a short-circuit between the metallic parasitic patch and the RF-ground metallic layer, the remaining shorting pins surrounding the conductive feed via and creating a short-circuit between the metallic radiating patch and the RF-ground metallic layer, whereby in response to an RF excitation signal being applied to the conductive feed via first and second strongly coupled resonant modes are generated, the first resonant mode being located at a distal end of the probe-fed patch antenna and the second resonant mode being located in the slot between the metallic parasitic patch and the metallic radiating patch.

According to a further aspect of the invention, a broadband phased array antenna system is provided, comprising: a support member; an antenna array mounted to the support member, the antenna array having a plurality of uniformly excited hybrid radiating elements arranged in a symmetric array on a substrate; a baseband controller mounted to the support member; a radio controller mounted to the support member for modulating and demodulating signals between the baseband controller and antenna array; and a communications interface for removably connecting and disconnecting the antenna system.

BRIEF DESCRIPTIONS OF THE DRAWINGS

Embodiments are described with reference to the following figures, in which:

FIG. 1 depicts broadband phased array antenna system, according to an aspect of the invention;

FIGS. 2A-2C depict a hybrid radiating element in isometric, top, and side views, respectively, in accordance with a further aspect of the invention;

FIGS. 3A-3C depict the hybrid radiating element of FIGS. 2A-2C with a GCPW feeding network; and FIG. 4 is a schematic representation of an antenna array in accordance with an additional aspect of the invention.

DETAILED DESCRIPTION

As discussed in greater detail below with reference to FIGS. 1-4, according to an aspect of this specification a phased array antenna system is set forth that includes a hybrid radiating element for MMW communications covering large annular angles over a broad operating bandwidth with minimum gain fluctuation. In addition to incorporating a hybrid radiating element, an exemplary antenna array feeding network and associated lattice geometry are set forth for realizing a stable high gain radiation pattern over WiGig operating frequencies from 56 GHz to 66 GHz, a minimum gain of 18±0.5 dB with minimum gain fluctuation at extreme scanned angles, and azimuthal scan range of at least ±45°.

FIG. 1 depicts an exemplary broadband phased array antenna system 100 (also referred to herein as the system 100). The system 100 includes an antenna array 102 that is fabricated using any suitable fabrication technology, such as standard laminated PCB. The antenna array 102 is mounted to a support member 104. In the present example, the support member 104 is a multi-layer application board carrying, either directly or via additional support members, a baseband controller 106 and a radio controller 108, which are mounted using BGA flip-chip assembly methodology on a side opposite to the antenna array 102, resulting in an integrated solution (i.e. AiP). The AiP method of system integration results in a low cost and high yield solution for the entire phased array antenna system 100. It will be appreciated that the system 100 may be configured as a low-cost solution for other communications standards/applications, for example by changing only the antenna and software (e.g. based on required beamforming algorithm and standards other than WiGig).

Radio controller 108, which may also be referred to as a transceiver, includes one or more integrated circuits (e.g. FPGA), and is generally configured to receive demodulated data signals from the baseband controller 106 and encode the signals with a carrier frequency for application to the antenna array 102 for wireless transmission. Further, the radio controller 108 is configured to receive signals from the antenna array 102 corresponding to incoming wireless transmissions, and to process those signals for transmission to the baseband controller 106.

The baseband controller 106 is implemented as a discrete integrated circuit (IC) in the present example, such as a field-programmable gate array (FPGA). In other examples, the baseband controller 106 may be implemented as two or more discrete components. In further examples, the baseband controller 106 is integrated within the support member 104.

The system 100, in general, is configured to enable wireless data communications between computing devices (not shown). In the present example, the wireless data communications enabled by the system 100 are conducted according to the WiGig standard, as discussed above. As will be apparent, however, the system 100 may also enable wireless communications according to other suitable standards, employing other frequency bands.

The system 100 can be integrated with a computing device, or, as shown in FIG. 1, can be a discrete device that is removably connected to a computing device. As a result, the system 100 includes a communications interface 114, such as a Universal Serial Bus (USB) port, configured to connect the remaining components of the system 100 to a host computing device (not shown).

FIGS. 2A-2C show a hybrid radiating element 200 forming part of the antenna array 102. The hybrid radiating element 200 comprises a probe-fed patch antenna having an excitation probe in the form of a conductive feed via 205 and metallic radiating patch 210, a shorted metallic parasitic patch 220, and four shorting pins 230, one of which (230') short-circuits the parasitic patch 220 and the other three short-circuit the metallic radiating patch 210. The forgoing metallic elements are implemented within two stacked dielectric layers 240 and 250, wherein layer 250 is a core layer on top of which the metallic parasitic patch 220 and parasitic patch 220 are etched. A reference RF-ground metallic layer 260 is provided at the bottom of dielectric layer 250. In accordance with one aspect of the invention, the shorted and probe-fed patches 220 and 210, create two types of coupled resonant modes. One resonant mode appears at the end 270 of the probe-fed patch antenna (perturbed electric-type radiation similar to that of a planar inverted-F antenna (PIFA) and the other occurs within the slot 265 between the two patches (magnetic-dipole type radiation). In another aspect, the shorted parasitic patch 220 also helps to improve the radiation pattern gain drop when the beam is directed toward larger angles by controlling the propagation of surface and/or leaky waves in the top dielectric 240.

In another aspect of the invention, the three shorting pins 230 connected to metallic radiating patch 210 are used in conjunction with the fourth shorting pin 230' connected to patch 220 to mimic a coaxial-like transition and smoothly match the electromagnetic fields of the magnetic-type resonant mode in the slot 265 between the two patches and the perturbed electric-type resonant mode at the end 270 of the probe-fed patch antenna. Furthermore, the three shorting pins 230 connected to metallic radiating patch 210 reduce the cross-polarization level of the patch antenna and improve the scan performance of the hybrid element when used in the antenna array 102.

It is known in the art to use a strip-line transmission line as an excitation for the patch antenna. However, because of the abrupt bend at the probe-line connection, the input reactance of the radiating element is strongly dispersive and worsens at higher frequencies. To avoid this problem and achieve better impedance matching performance, a GCPW feeding network is provided according to a further aspect for providing a propagating mode compatible with coaxial-like transition, as shown in FIGS. 3A-3C. The GCPW feeding network comprises a grounded coplanar waveguide (GCPW) transmission line 300, which is surrounded by a plurality of metallic vias 310, for exciting the conductive feed via 205, resulting in a quarter-wavelength transition at the probe-line connection for reducing impedance mismatch.

As shown in FIGS. 3A-3C, the exemplary hybrid radiating element comprises four stacked dielectric layers 240, 250, 320 and 330, metallic radiating patch 210, shorted metallic parasitic patch 220, conductive feed via 205, four shorting pins 230 and 230' passing through the second, third and fourth dielectric layers 250, 320 and 330, respectively, GCPW transmission line 300, and metallic vias 310 for shielding the transmission line 300. In the second layer 250, the vias 230 that short circuit the (probe-fed) patech antenna reduce the cross-polarization of radiated electromagnetic fields and improve the scan performance, while the fourth via 230' suppresses surface wave propagation by short circuiting the parasitic patch 220. The RF conductive feed via 205 surrounded by all four shorting pins 230 and 230' in the second, third, and fourth dielectric layers 250, 320 and 330 and vias 310 in the third and fourth dialectic layers 320 and 330, mimic a coaxial type field that matches with the fields in the GCPW transmission line 300. Therefore, a smooth field transition is realized and the antenna is matched over a wide operating bandwidth. A plurality of vias 340 are used to shield the CPW-transmission line 300 in the subarray level. Although the vias 340 are illustrated as being semi-cylindrical in the unit cell depicted in FIGS. 3A-3C, in an array configuration such as shown in FIG. 4, the vias 340 in each row between subarrays are cylindrical.

The top dielectric layer 240 is used as protection for the metallic radiating patch 210 and parasitic patch 220 in its bottom face. Dielectric layer 250 functions as a supporting layer for the patches 210 and 220 on its top surface and reference RF-ground metallic layer 260 on its bottom surface. Dielectric layer 320 accommodates the GCPW transmission line 300 on its bottom face, and dielectric layer 330 supports a conductive ground plane for the transmission line 300. Conductive feed via 205 passes through the second and third layers 250 and 320 for transmitting the RF-signal through the feeding network comprising GCPW transmission line 300 and metallic vias 310 from a location behind the antenna array 102 to the hybrid radiating element 200, as discussed in greater detail below with reference to FIG. 4. Shorting pin 230' connects the parasitic patch 220 to the RF-ground metallic layer 260 for creating a magnetic dipole-type radiation through the slot between patches 210 and 220, and also suppresses the propagation of surface waves. The other three shorting pins 230 surround the conductive feed via 205 and connect the metallic radiating patch 210 to its RF-ground metallic layer 260 to avoid cross-polarization excitation and suppress the propagation of surface waves. Furthermore, the four shorting pins 230, 230' pass through the third and fourth dielectric layers 320 and 330 and surround the RF conducting via 205 to facilitate a smooth RF-signal transition from the transmission line 300 to the patch 210 through the conductive feed via 205. Stacking vias 230, 230' on top of each other in each of the second, third and fourth dielectric layers 250, 320 and 330, also simplifies fabrication.

The combination of shorted parasitic patch 220 and the radiating probe-fed patch 210 with its three shorting pins 230 create strongly coupled dual hybrid mode resonances and hence broad bandwidth operation. As discussed above, the hybrid radiating element 200 functions essentially as a combination of a slot radiator and perturbed probe-fed patch, creating an asymmetric radiating structure suitable for wide-band and wide angle scanned phased array antennas. In an alternative aspect of operation, the hybrid radiating element 200 functions essentially as a slot-loaded planar inverted-F antenna (PIFA).

Simulated testing of the hybrid radiating element with GCPW feeding network, as discussed above with reference to of FIGS. 3A-3C, shows that at lower frequencies, the open edge 270 of the probe-fed patch 210 effectively radiates, while at higher frequencies, the slot 265 between patches 210 and 220 is the dominant radiator. Therefore, in contrast with prior art probe-fed patch antennas, the hybrid radiating element 200 generates an additional resonance frequency that is effectively coupled with the second excited mode, with both modes having a similar radiation pattern.

FIG. 4 shows an antenna array 102 comprising a plurality of uniformly excited radiating hybrid-elements, such as hybrid radiating element 200 described above with respect to FIGS. 2A-2C and FIGS. 3A-3C, arranged symmetrically on a substrate 400. In the illustrated embodiment, 32 hybrid radiating elements 200 are grouped in eight 1×4 subarrays 405, each being fed with RF excitation signals via a GCPW transmission line 300. The GCPW transmission lines for the eight subarrays 405 are connected to radio controller 108 through strip lines 410 having equal lengths and via transitions 420. The strip lines 410 are arranged with aperiodic element distancing to improve the bandwidth and impedance matching of the phased array elements. As discussed above, a symmetric array geometry is employed, represented by the left and right portions of the antenna array 102 on opposite sides of the symmetry plane depicted in FIG. 4, to obtain reduced mutual coupling between elements and an improved radiated far field pattern. To compensate for anti-phase currents of subarray elements located on the opposite sides of the symmetric plane, the elements on the left are excited with oppositely phased signals to the elements on the right. Sections of artificial material 430 are provided on left and right regions to mimic an almost infinite array environment, suppress surface and edge scattered waves in the E-plane and thereby improve the antenna gain and radiation pattern shape. In one embodiment, the artificial material 430 used on each side comprises three columns of mushroom-shaped electromagnetic-band-gap (EBG) material.

Testing of the co-polarized and cross-polarized radiation patterns of the antenna array 102 set forth above for different channels over the desired bandwidth has shown that the antenna has a broad operating bandwidth with low cross-polarized stable radiation pattern. In some tests, the side lobe level is better than −10 dB over the entire bandwidth. To prove scan performance, the antenna array 102 was calibrated using HFSS software (High Frequency Structure Simulator) at 60 GHz, and the radiation pattern of phased array system was measured for different scanned angles. In some tests, it has been shown that the antenna array 102 can effectively and efficiently provide a high gain beam pattern that azimuthally covers at least ±45° angular area without the appearance of any unwanted grating lobe, with scan loss better than −4 dB, and side lobe level smaller than −10 dB over the entire desired bandwidth.

It will be appreciated from the foregoing that the phased array antenna system set forth herein is characterized by a large angle scanned-beam, small gain drop at extreme scanned angles, and stable radiation performance over a broad frequency band. The hybrid radiating element 200 described above, with symmetric array pattern geometry, associated GCPW excitation signal feeding mechanism and incorporation of EBG materials provides improved performance for MMW applications and operating frequencies, suitable for 5th generation (5G), indoor, or short range wireless communication systems.

The scope of the claims should not be limited by the embodiments set forth in the above examples, but should be given the broadest interpretation consistent with the description as a whole.

The invention claimed is:

1. A hybrid radiating element, comprising:

a first dielectric layer stacked on a second dielectric layer;

an RF-ground metallic layer disposed on a bottom surface of the second dielectric layer;

a probe-fed patch antenna having a metallic radiating patch disposed on a top surface of second dielectric layer and a conductive feed via between the metallic radiating patch and the RF-ground metallic layer;

a metallic parasitic patch disposed on the top surface of the second dielectric layer and separated from the metallic radiating patch by a slot; and a plurality of shorting pins, one of said shorting pins creating a short-circuit between the metallic parasitic patch and the RF-ground metallic layer, the remaining shorting pins surrounding said conductive feed via and creating a short-circuit between the metallic radiating patch and the RF-ground metallic layer, whereby in response to an RF excitation signal being applied to the conductive feed via first and second strongly coupled resonant modes are generated, said first resonant mode being located at a distal end of the probe-fed patch antenna and said second resonant mode being located in the slot between the metallic parasitic patch and the metallic radiating patch.

2. The hybrid radiating element of claim 1, comprising three said remaining shorting pins for reducing cross-polarization of the probe-fed patch antenna and improving scan performance and which, in conjunction with said one of said shorting pins, match electromagnetic fields of the second resonant mode in said slot and the first resonant mode at the distal end of the probe-fed patch antenna.

3. The hybrid radiating element of claim 2, further comprising:

a third dielectric layer stacked on a fourth dielectric layer, the second dielectric layer being stacked on said third dielectric layer;

a conductive ground plane disposed on a bottom surface of the fourth dielectric layer;

a grounded coplanar waveguide (GCPW) disposed on a bottom surface of the third dielectric layer; and a plurality of metallic vias for shielding the grounded coplanar waveguide (GCPW), wherein said RF excitation signal passes from the grounded coplanar waveguide (GCPW) and through the second and third dielectric layers to said conductive feed via.

4. A broadband phased array antenna system, comprising:

a support member;

an antenna array mounted to said support member, said antenna array having a plurality of uniformly excited hybrid radiating elements arranged in a symmetric array on a substrate, wherein each of said hybrid radiating elements further comprises an RF-ground metallic layer, a probe-fed patch antenna having a metallic radiating patch and a conductive feed via between the metallic radiating patch and the RF-ground metallic layer, a metallic parasitic patch separated from the metallic radiating patch by a slot, and a plurality of shorting pins, one of said shorting pins creating a short-circuit between the metallic parasitic patch and the RF-ground metallic layer, the remaining shorting pins surrounding said conductive feed and creating a short-circuit between the metallic radiating patch and the RF-ground metallic layer;

a baseband controller mounted to said support member;

a radio controller mounted to said support member for modulating and demodulating signals between the baseband controller and antenna array; and a communications interface for removably connecting and disconnecting the antenna system, whereby in response to an RF excitation signal being applied to the conductive feed via first and second strongly coupled resonant modes are generated, said first resonant mode being located at a distal end of the probe-fed patch antenna and said second resonant mode being located in the slot between the metallic parasitic patch and the metallic radiating patch.

5. The broadband phased array antenna system of claim 4, wherein said substrate comprises a laminated printed circuit board (PCB).

6. The broadband phased array antenna system of claim 4, wherein said support member comprises a multi-layer application board.

7. The broadband phased array antenna system of claim 4, wherein said radio controller and antenna array are mounted on opposite sides of said support member and interconnected by a plurality of metallic vias.

8. The broadband phased array antenna system of claim 4, wherein said antenna array, baseband controller and radio controller are mounted to the support member using a BGA flip-chip assembly.

9. The broadband phased array antenna system of claim 4, wherein said communications interface is a Universal Serial Bus (USB) port.

10. The broadband phased array antenna system of claim 4, wherein said antenna array further comprises:

a hybrid feeding network for transmitting RF-signals to said hybrid radiating elements; and artificial materials surrounding opposite sides of the symmetric array for suppressing edge scattered fields and increasing gain of the antenna system.

11. The broadband phased array antenna system of claim 10, wherein said hybrid feeding network comprises a grounded coplanar waveguide (GCPW) and strip lines.

12. The broadband phased array antenna system of claim 4, wherein each of said hybrid radiating elements further comprises:

a first dielectric layer stacked on a second dielectric layer;

wherein the RF-ground metallic layer is disposed on a bottom surface of the second dielectric layer;

wherein the metallic radiating patch is disposed on a bottom surface of the first dielectric layer; and wherein the metallic parasitic patch is disposed on the top surface of the second dielectric layer.

* * * * *